US006426596B1

(12) United States Patent
Yamamoto et al.

(10) Patent No.: US 6,426,596 B1
(45) **Date of Patent: *Jul. 30, 2002**

(54) IMAGE FORMING APPARATUS

(75) Inventors: Keisuke Yamamoto, Yamato; Tamaki Kobayashi, Isehara; Satoshi Mogi, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/506,602

(22) Filed: Feb. 18, 2000

(30) Foreign Application Priority Data

| | | |
|---|---|---|
| Feb. 22, 1999 | (JP) | 11-043741 |
| Feb. 25, 1999 | (JP) | 11-049108 |
| Feb. 15, 2000 | (JP) | 2000-036976 |

(51) Int. Cl.[7] ..... G09G 3/12

(52) U.S. Cl. ..... 315/169.1; 315/169.3; 315/169.4; 313/336; 313/495

(58) Field of Search ..... 315/169.1, 169.3, 315/169.4; 313/495, 496, 336

(56) References Cited

U.S. PATENT DOCUMENTS 5,592,056 A 1/1997 Peyre et al. ..... 315/169.1

FOREIGN PATENT DOCUMENTS

| | | |
|---|---|---|
| EP | 0 866 491 | 9/1998 |
| JP | 10-134740 | 5/1998 |
| JP | 10-326583 | 12/1998 |

*Primary Examiner*—David Vu
(74) *Attorney, Agent, or Firm*—Fitzpatrick, Cella, Harper & Scinto

(57) ABSTRACT

An image forming apparatus includes a cathode substrate on which an electron emitting device is disposed, and an anode substrate disposed opposite to the cathode substrate. The anode substrate includes an anode electrode including a plurality of conductive films connected in series and arranged to form gaps between neighboring films.

26 Claims, 14 Drawing Sheets a: CONDUCTOR WIDTH
b: SPACE BETWEEN CONDUCTOR
c: NUMBER OF TURNS

IMAGE FORMING APPARATUS

BACKGROUND OF THE INVENTION

1. Field of the Invention

The present invention relates to an image forming apparatus provided with an anode section and a cathode section, and particularly to a flat panel display which emits lights via an electron beam.

2. Related Background Art

In recent years, a flat panel type image forming apparatus formed of an anode section and a cathode section has been broadly researched and developed. An electron emitting device for use is constituted, for example, of a field emitter, a surface conduction electron emitting device, and the like.

One example of use of the electron emitting device is proposed in U.S. Pat. No. 5,592,056, Japanese Patent Application Laid-Open Nos. 10-134740, 10-326583, and the like.

A schematic sectional view of such image forming apparatus is shown in FIG. 9. These image forming apparatuses are different in the structure of the electron emitting device, a driving method, and the like, but are characterized in common in that a cathode section 5 constituted of an electron source of a plurality of electron emitting devices is allowed to emit electrons, and that an anode section 4 is disposed in the vicinity of the cathode section 5. Additionally, numeral 1 denotes an anode substrate, 2 denotes an outer frame, 3 denotes a cathode substrate, and these components form a hermetically sealed container 7. A high vacuum of $10^{-5}$ Pa or more is maintained in the hermetically sealed container. A phosphor is placed on this anode section 4, and is irradiated with electrons accelerated by a voltage applied to the anode electrode 4, so that the phosphor emits light and an image can be formed.

In the flat panel type image forming apparatus, a distance between the cathode section 5 and the anode section 4 is in a range of about several hundreds of micrometers to several millimeters.

Usually, when the image forming apparatus forms images for a long time, a vacuum arc discharge is observed in some cases. The current of this abnormal discharge differs with the voltage applied to the anode electrode included in the anode section, the region of the anode electrode, the distance between the anode section and the cathode section, and the like, but in some cases ranges from several amperes to several hundreds of amperes. The abnormal discharge is considered to be caused by an insufficient vacuum state between the cathode section and the anode section, or by an abnormal electric field formed by an electrode shape or a triple junction constituted of the contact point of the vacuum, electrode (metal) and insulating material.

Once such abnormal electric discharge occurs, the current is concentrated on the discharge section, and the anode and cathode sections are damaged in some cases. This vacuum arc discharge results in a large current, and a large amount of Joule heat by the current may cause the collapse of the electron emitting device in the cathode section. Moreover, the current concentration forms an unstable potential in the cathode section and connection wiring. As a result, the devices connected via the wiring are considered to be damaged. A conventional technique of providing the anode section with a resistor section to suppress the vacuum arc generation is disclosed, for example, in the Japanese Patent Application Laid-Open No. 10-134740.

SUMMARY OF THE INVENTION

According to one aspect of the present invention, there is provided an image forming apparatus comprising: a cathode substrate on which an electron emitting device is disposed; and an anode substrate provided with an anode electrode partially having a gap, and disposed opposite to the cathode substrate. The anode electrode is a physically continuous electrode comprising a plurality of conductive films electrically interconnected in series.

According to another aspect of the present invention, there is provided an image forming apparatus comprising: a cathode substrate on which an electron emitting device is disposed; and an anode substrate provided with an anode electrode partially having a gap, and disposed opposite to the cathode substrate. The anode electrode has an inductance of 1 $\mu$H or more.

According to another aspect of the present invention, there is provided an image forming apparatus comprising: a cathode substrate on which an electron emitting device is disposed; and an anode substrate provided with an anode electrode, and disposed opposite to the cathode substrate. The anode electrode is an electrode formed by physically connecting a plurality of substantially rectangular conductive films, the plurality of conductive films are arranged substantially parallel with one anther in a longitudinal direction, and arranged with gaps in a direction substantially orthogonal to the longitudinal direction, and adjacent conductive films are interconnected at one end in the longitudinal direction so that the plurality of conductive films are electrically interconnected in series.

According to another aspect of the present invention, there is provided an image forming apparatus comprising: a cathode substrate on which an electron emitting device is disposed; and an anode substrate provided with an anode electrode, and disposed opposite to the cathode substrate. The anode electrode is a physically continuous electrode having a substantially square shape, a plurality of linear gaps (recessed portions) are extended from outer peripheral portions corresponding to two opposite sides among the sides of the square shape, the linear gaps (recessed portions) are substantially parallel with one another, the gap (recessed portion) extended from one of the two sides are extended toward the other side, and the linear gaps (recessed portions) are arranged in a zigzag pattern.

According to another aspect of the present invention, there is provided an image forming apparatus comprising: a cathode substrate on which an electron emitting device is disposed; and an anode substrate provided with an anode electrode partially having a gap, and disposed opposite to the cathode substrate. The gap has a spiral shape extended toward the central portion of the anode electrode from the outer peripheral portion of the anode electrode.

According to another aspect of the present invention, there is provided an image forming apparatus comprising: a cathode substrate on which an electron emitting device is disposed; and an anode substrate provided with a conductive film partially having a gap, and disposed opposite to the cathode substrate. The conductive film has a shape drawn with a single stroke.

According to another aspect of the present invention, there is provided an image forming apparatus comprising: a cathode substrate on which an electron emitting device is disposed; and an anode substrate provided with an anode electrode partially having a gap, and disposed opposite to the cathode substrate. The anode electrode comprises a physically continuous anode electrode having a substantially square shape, and has a spiral shape extended toward the central portion of the anode electrode from the outer peripheral portion of the square shape.

DETAILED DESCRIPTION OF THE PREFERRED EMBODIMENTS

In order to avoid the above-described disadvantages, it is most important to generate no abnormal electric discharge between an anode section and a cathode section. Actually, however, in an image forming apparatus, it is difficult to completely prevent the abnormal discharge with good yield. Therefore, it is important to apply a countermeasure for alleviating the damage if the abnormal discharge occurs, and the countermeasure has been demanded.

Figure 8B:
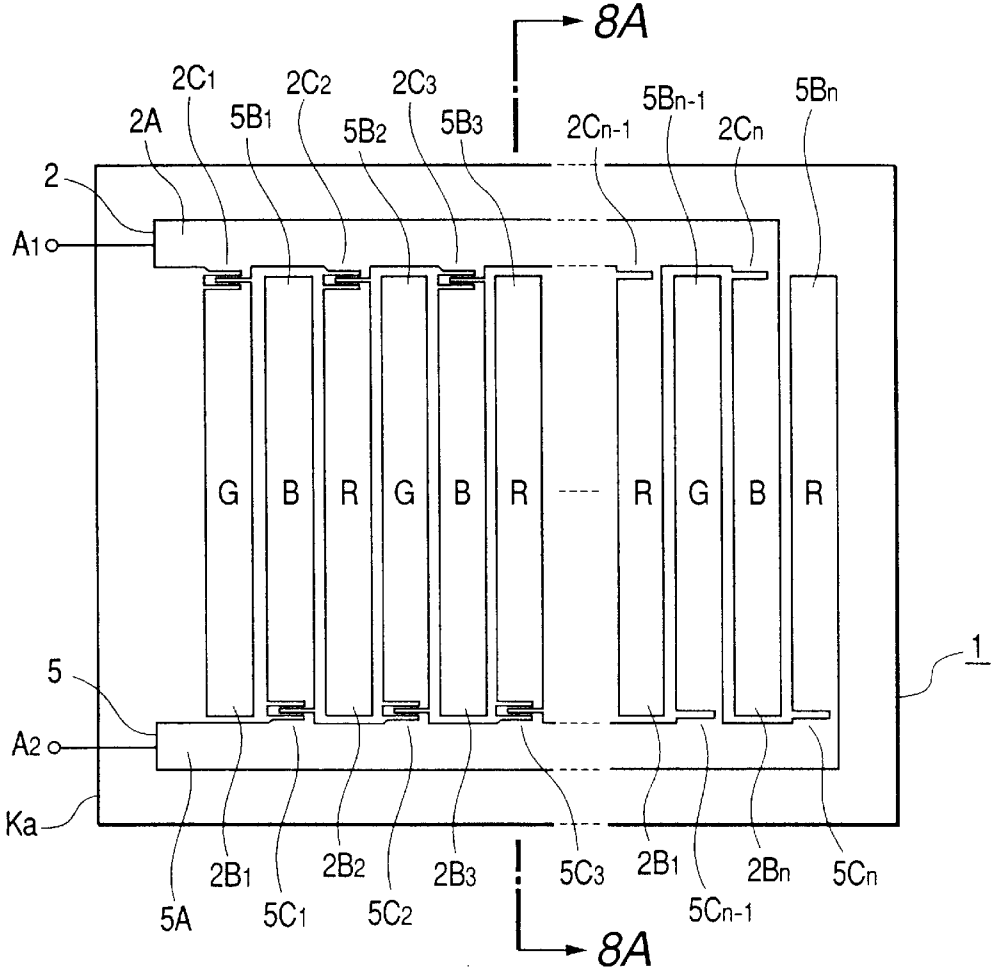
FIGS. 8A and 8B are schematic plan views showing the main constitution of the anode substrate of a conventional image forming apparatus.
Figure 8A:
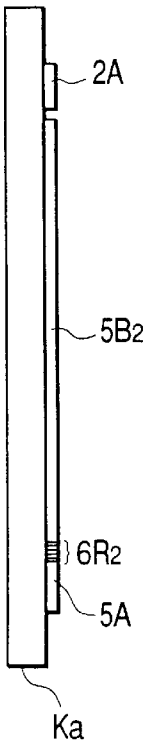
Figure 9:
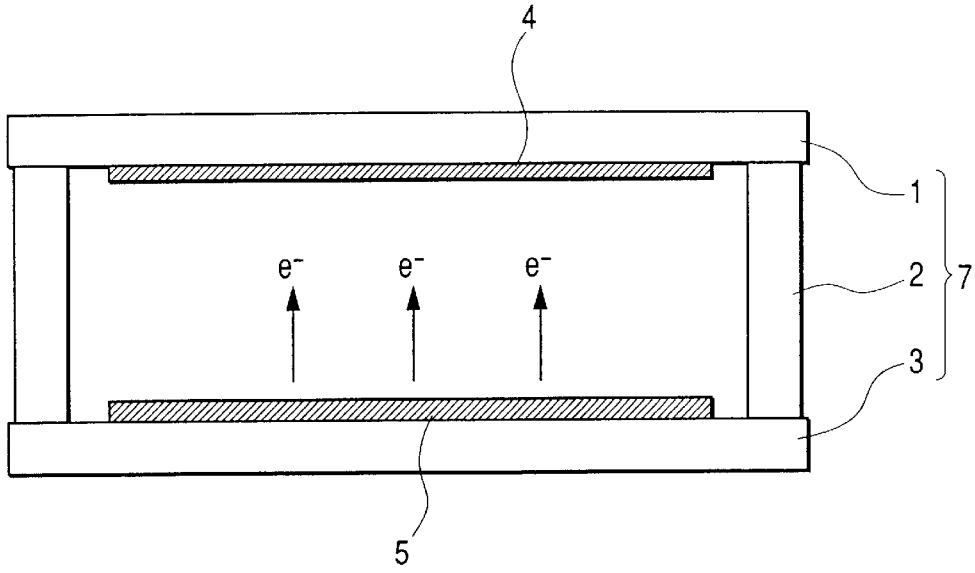
FIG. 9 is a schematic sectional view of a flat panel type image forming apparatus.

The technique disclosed in the Japanese Patent Application Laid-Open No. 10-134740 is shown in FIGS. 8A and 8B. In an anode substrate 1, phosphors R, G, B are formed on stripe electrodes (anode electrodes), and every other phosphor on the stripe electrode is connected to a conductive section 2A or 5A. Therefore, the anode electrodes are divided into two groups each of which is connected to the conductive section 2A or 5A and has a comb teeth shape. A resistor material is formed on each stripe electrode by forming a cutout by techniques such as laser trimming. This can lower an effective voltage when micro discharge occurs. However, anode voltage is in a range of about 200 to 300 V. In such a low voltage, there is a problem that the emitting luminance by the electron beam is weak.

In order to obtain the luminance as high as that of CRT, it is demanded that the image forming is performed by raising the anode voltage in a range of about 5 kV to 15 kV. However, when light is emitted by raising the anode voltage in a range of 5 kV to 15 kV or more, in a large-screen image forming apparatus with a large electrostatic capacity between the anode section and the cathode substrate, a large amount of electric charge is accumulated in the anode section and the cathode substrate. This electric charge disadvantageously moves through a discharge path in accordance with a drop of the potential of the anode section when the vacuum arc discharge starts. When this electric charge momentarily moves, the value of current is considerably large. Therefore, in the method of the Japanese Patent Application Laid-Open No. 10-134740, the voltage drop by the resistor material is excessively large, and a large potential difference and surface discharge (flashover) are generated between adjacent stripe electrodes, which results in a problem that the anode section is destroyed.

The present invention has been developed in consideration of the above-described problem, and an object thereof is to provide a remarkably reliable image forming apparatus in which various damages such as a pixel defect attributed to abnormal discharge can effectively be inhibited.

In the image forming apparatus of the present invention, the anode electrode comprises a single anode electrode which has a gap (electric insulating portion), but which is physically continuous. In the anode electrode of the present invention, the gap (electric insulating portion) forms the electric obstruction of a current channel in the anode electrode, and the current flowing through the anode electrode flows around (detour around) the gap. Furthermore, in the anode electrode of the present invention, by appropriately disposing the gap (electric insulating portion) without cutting off the current channel of the anode electrode, the current channel can be lengthened, for example, in a zigzag or spiral shape. By forming the anode electrode as a long current channel in this manner, the current path is substantially univocally defined on the detour current channel when the abnormal discharge occurs between the cathode section and the anode section and short-circuit momentarily occurs. Therefore, the time required for releasing (discharging) the electric charge can be lengthened (the amount of electric charge moving per unit time can be reduced). Since the damage of the cathode or anode section attributed to the abnormal discharge is proportional mainly to the amount of current, the occurrence of the damage can be alleviated to an ignorable degree by lengthening the time of the electric charge release.

The image forming apparatus to which the present invention is applied will be described hereinafter in detail with reference to the drawings.

Figure 1:
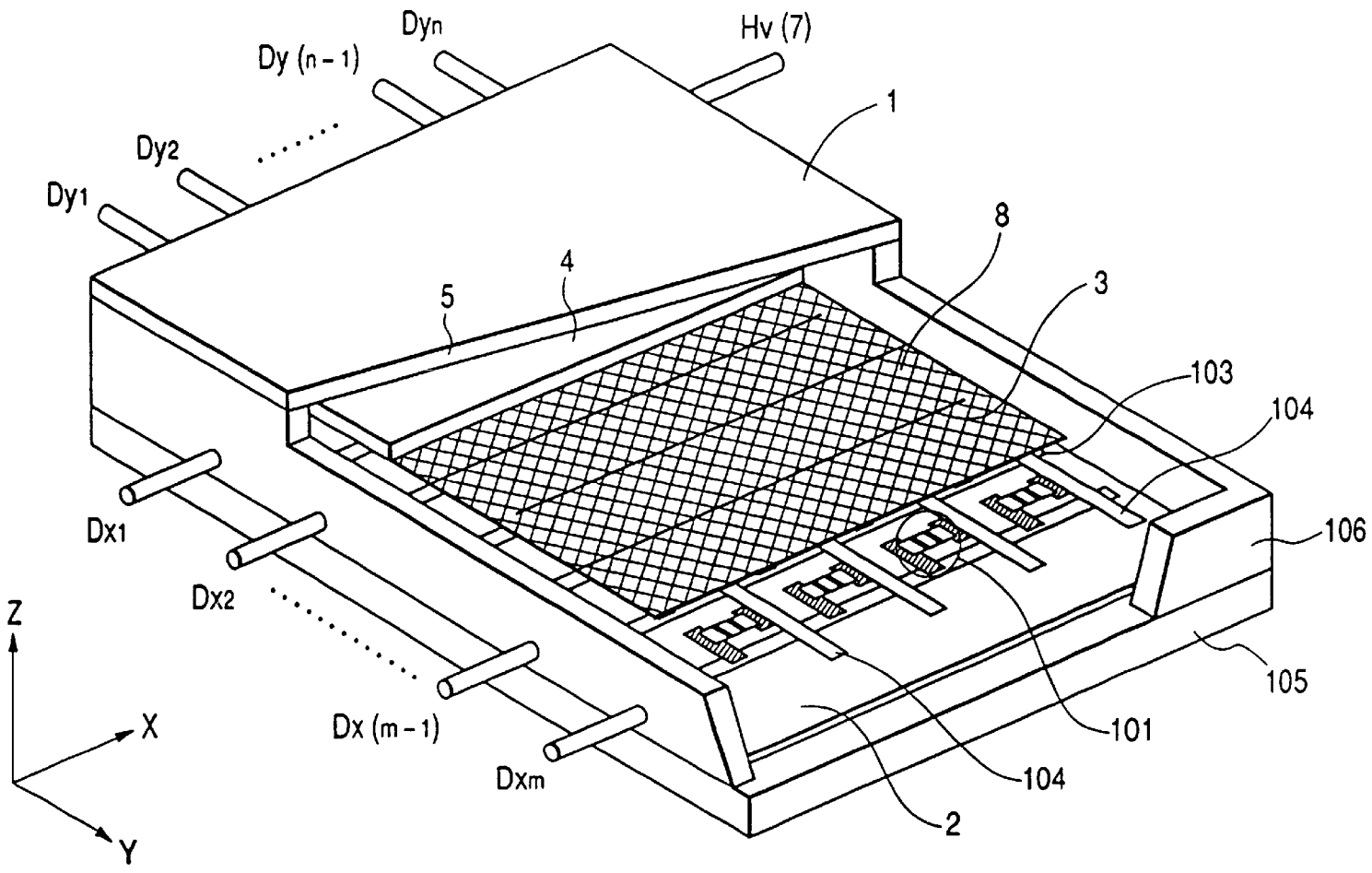
FIG. 1 is a schematic perspective view showing the main constitution of an image forming apparatus according to an embodiment of the present invention.

FIG. 1 is a schematic perspective view showing one example of the image forming apparatus comprising an anode substrate 1 and a cathode substrate 2 according to the present invention. Each of the anode substrate 1 and the cathode substrate 2 has a substantially square shape, and an image forming region similarly has a substantially square shape. Each of the anode substrate and the cathode substrate is basically constituted of an insulating member, and is preferably a glass substrate.

In FIG. 1, on the cathode substrate 2, a large number of surface conduction electron emitting devices 101 (shown in a circle in FIG. 1) for use as electron sources are arranged in a matrix manner to form a cathode section 104. Here, the example in which the surface conduction electron emitting devices are used is shown, but in the present invention, the type of the electron emitting device is not particularly limited. As the electron emitting device which can be used in the present invention, a cold cathode or a thermionic cathode can be used. Moreover, a field emitter, a MIM type electron emitting device, and the like can be used.

In FIG. 1, numeral 5 denotes an anode substrate. In FIG. 1, numeral 8 denotes a conductive film (anode electrode), which covers a phosphor layer 4 having three primary color (Red, Green, Blue) phosphors 10 for performing color display. Moreover, cutout portions (gap portions) 3 extended from an outer periphery are formed in the conductive film (anode electrode) 8, but the film is substantially square as viewed in a macro manner. Moreover, the conductive film (anode electrode) 8 is preferably a metal film, more preferably an aluminum film. A high voltage in a range of 5 kV to 15 kV is applied to the conductive film (anode electrode) 8 via a high-voltage terminal Hv from a power source (not shown). Moreover, when the permeability of the electron emitted from the electron emitting device, and the reflecting properties of the light emitted from the phosphor 10 are taken into account, the thickness of the anode electrode (conductive film) 8 is in a range of several tens of nanometers to several hundreds of nanometers, preferably 40 nm (not less than 40 nm) to 300 nm (not more than 300 nm). Additionally, in this example, three primary color phosphors are used, but in monochromatic display, the phosphor layer 4 has a single-color phosphor. Moreover, the phosphor layer 4 may have an interval defining member 6 disposed between the phosphors, in addition to the phosphor 10. The interval defining member is preferably a black member, and is sometimes called "black stripe" or "black matrix". The phosphor layer 4 has a sufficient insulating property as compared with the conductive film 8.

Additionally, the "anode electrode", "conductive film", or "metal back" disposed on the anode substrate of the present invention is a member for irradiating the image forming member (phosphor) with the electron emitted from the electron emitting device on the cathode substrate, or a portion to which a potential higher than any other potential applied to the member on the cathode substrate is applied in order to accelerate the electron emitted from the electron emitting device on the cathode substrate. Moreover, the "anode electrode", "conductive film", or "metal back" in the present invention is not constituted of a plurality of physically discontinuous members on substantially the same plane as described in the Japanese Patent Application Laid-Open No. 10-134740. Specifically, the component exists as a single physically continuous member on substantially the same plane.

Furthermore, numeral 103 denotes an X-direction wiring, 104 denotes a Y-direction wiring, and the wirings are substantially orthogonal to each other and electrically insulated from each other. The X-direction wiring and Y-direction wiring are connected to the electron emitting device.

Numeral 105 denotes a rear plate for supporting the cathode substrate 2, and 106 denotes a support frame to which the anode substrate 1 and the cathode substrate 2 are fixed. Additionally, in this example, the cathode substrate and the rear plate are constituted of separate members, but the rear plate is not particularly necessary when a sufficiently strong substrate is applied to the cathode substrate. Moreover, in this case, the cathode substrate may be called the rear plate. The cathode substrate (rear plate), support frame, and anode substrate constitute a hermetically sealed container. The inside of the hermetically sealed container differs with the electron emitting devices for use, but pressure is reduced, and preferably a vacuum degree of $10^{-6}$ Pa or more, more preferably a vacuum degree of $10^{-7}$ Pa or more is held.

Figure 2A:
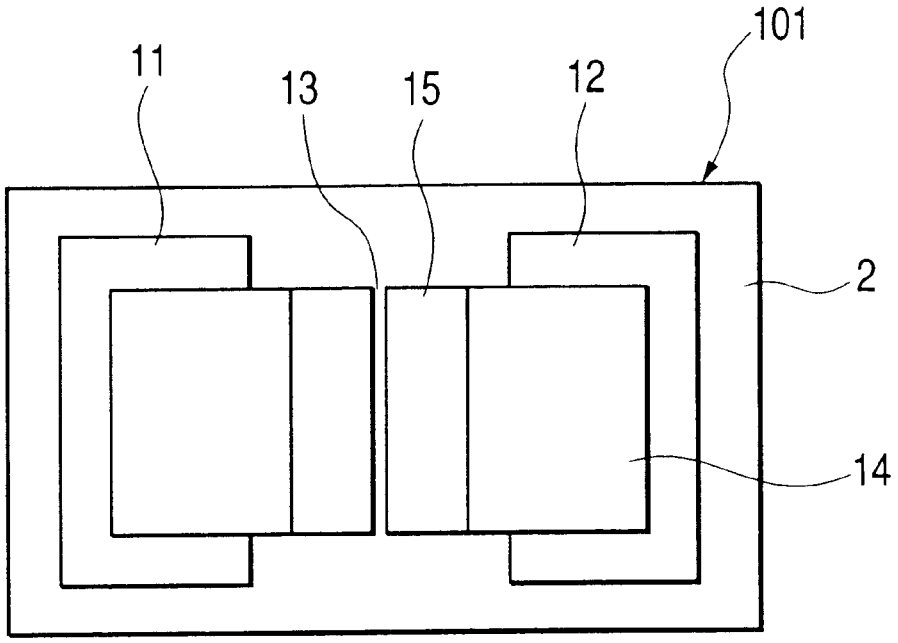
FIGS. 2A and 2B are schematic views showing a surface conduction electron emitting device.
Figure 2B:
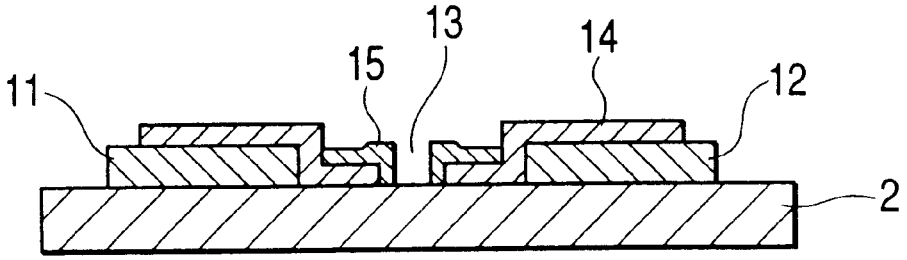

FIGS. 2A and 2B are schematic views showing the surface conduction electron emitting device 101 shown in FIG. 1, FIG. 2A is a plan view thereof, and FIG. 2B is a sectional view.

This electron emitting device 101 comprises a pair of adjacent electrodes 11, 12 on the cathode substrate 2, and a conductive thin film 14 connected to these electrodes 11, 12 and having a gap 13. Moreover, a film 15 mainly composed of carbon or carbon compound is formed in the periphery of the gap 13.

For this electron emitting device 101, by applying a voltage of about 15 V between the electrodes 11, 12, a current "If" is supplied between the electrodes 11, 12, so that the electrons can be emitted.

Figure 3A:
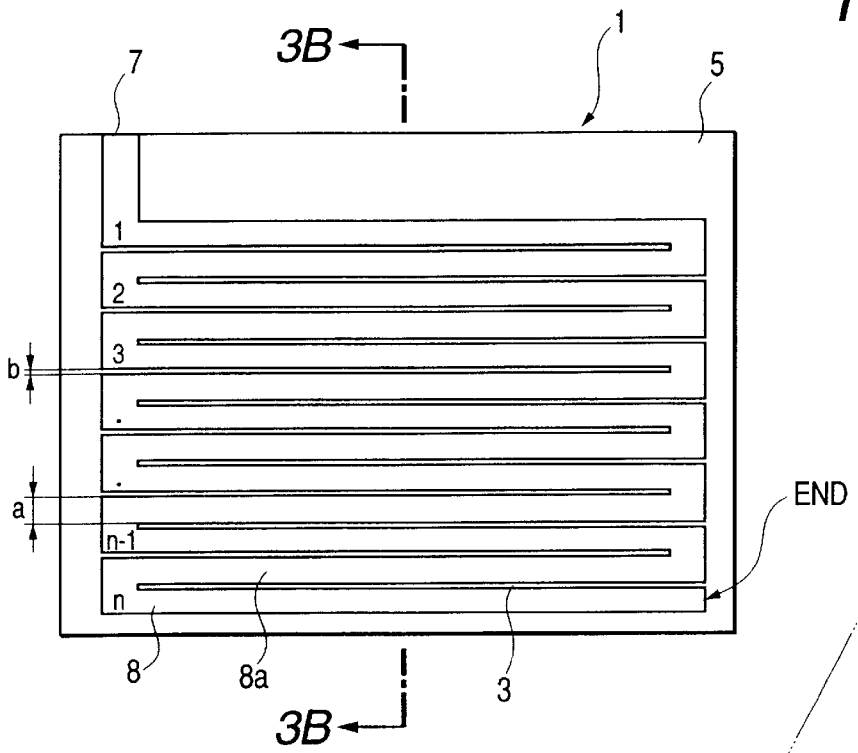
FIGS. 3A, 3B and 3C are schematic views showing the main constitution of an anode substrate.
Figure 3B:
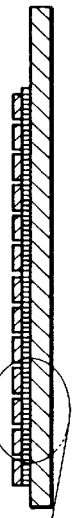
Figure 3C:
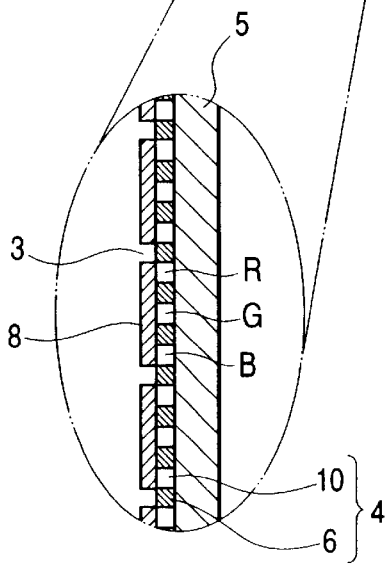

FIGS. 3A, 3B and 3C show schematic views of the anode substrate 1 as viewed from the side of the cathode substrate: FIG. 3A is a plan view thereof; FIG. 3B is a sectional view taken along line 3A—3A; and FIG. 3C is an enlarged sectional view in a circle. In FIGS. 3A to 3C, numeral 7 denotes a high-voltage extracting section for applying a high-voltage necessary for accelerating an electron to an anode electrode 102 in the hermetically sealed container from the outside of the hermetically sealed container, 8 denotes a conductive film (metal back), and 3 denotes a fine linear gap (cutout (electric insulating portion)). The members with the same reference numerals as those in FIG. 1 indicate the same members.

Adjacent conduction paths 8*a* are electrically insulated from each other via the gap 3.

However, the gap 3 does not divide the anode electrode to a plurality of physically discontinuous pieces. Specifically, the anode electrode of the present invention has a gap, but necessarily exists as one physically continuous member.

Specifically, the phosphor layer 4 disposed under the conductive film 8, or the anode substrate is exposed to the gap 3.

In the embodiment shown in FIGS. 3A to 3C, the conductive film (metal back, anode electrode) 8 of the present invention is provided with the gap 3, and has a shape drawn with a single stroke. Alternatively, or in other words, the anode electrode (conductive film, metal back) of the present invention has a single-stroke drawn shape electrically connected (connected in series) to the high-voltage extracting section 7 as the end. Additionally, in FIGS. 3A to 3C, the gap 3 is formed in a zigzag shape.

Alternatively, or in other words, the anode electrode of the present invention is constituted of a plurality of conductive films electrically connected in series, and may be said to be a physically continuous single electrode.

Alternatively, or in other words, the anode electrode of the present invention is constituted by physically connecting a plurality of conductive films, by arranging substantially rectangular conductive films substantially parallel with one another in a longitudinal direction, and by arranging the conductive films with gaps in a direction substantially orthogonal to the longitudinal direction.

Furthermore, it can be said that the anode electrode is a single physically connected electrode constituted by connecting adjacent conductive films at one end of the longitudinal direction so that the plurality of conductive films are electrically connected in series.

Additionally, among the plurality of conductive films, in the direction substantially orthogonal to the longitudinal direction, for the conductive films other than a pair of conductive films positioned in an outermost section, one end of the longitudinal direction of the conductive film is connected to one end of the adjacent conductive film and the other end is connected to the other end of the adjacent conductive film.

Alternatively, or in other words, the anode electrode of the present invention is a single physically continuous electrode (conductive film) having a substantially square shape, and has a plurality of linear gaps (recessed portions) extended from outer peripheral portions corresponding to two opposite sides among the sides of the square shape. The linear gaps (recessed portions) are substantially parallel with one another, and the gaps (recessed portions) extended from one of the two sides are extended toward the opposite side. Furthermore, the linear gaps (recessed portions) are arranged in a zigzag shape or alternately.

Additionally, the total length of the conduction path 8*a* along the gap 3 is preferably formed to be equal to or more than the length of the diagonal of the substantially square anode substrate 1. Moreover, the total length of the gap 3 is preferably formed to be equal to or more than the length of the diagonal of the anode substrate 1.

Figure 4:
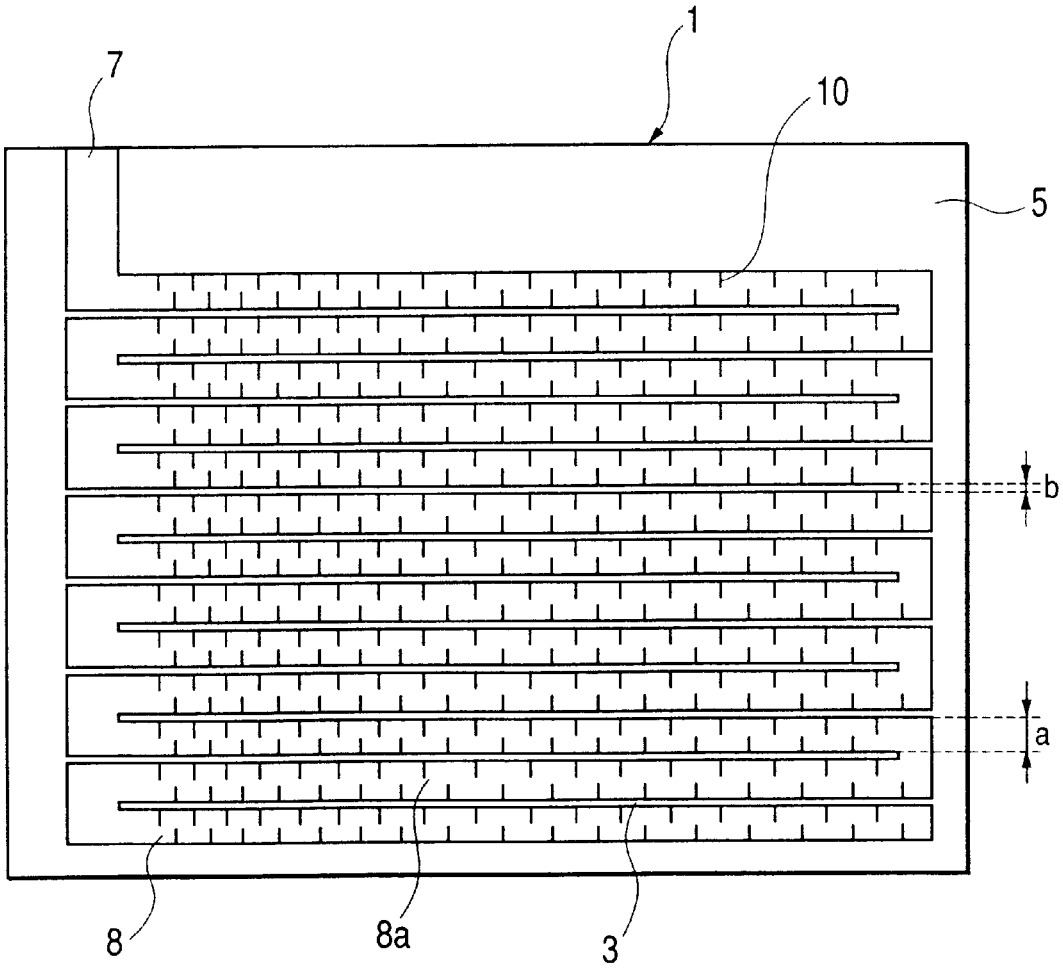
FIG. 4 is a schematic plan view showing another example of the conduction path shape of the metal back surface of the anode substrate.

Furthermore, in the anode electrode (conductive film) 8 of the present invention, as shown in FIG. 4, a plurality of linear second gaps 10 extended from the gaps 3 to be orthogonal to the gaps 3 may be arranged. Additionally, the plurality of second gaps may be arranged in the zigzag shape or alternately.

Moreover, in order to secure further insulating properties of the gaps 3 or the second gaps 10, the gaps may preferably be filled with insulating materials such as $SiO_2$.

Additionally, the pattern of the conductive film (anode electrode) can be formed by a method of forming the gaps 3 in one piece of the conductive film by processes such as laser trimming, a method of forming the material of the conductive film (anode electrode) 8 via a metal mask having a mask portion corresponding to the gap 3 by a vacuum deposition process, and the like. However, the method of forming the conductive film (anode electrode) 8 of the present invention is not limited to the above-described methods.

The conductive film (anode electrode, metal back) 8 is formed to cover the phosphor surface 4. Numeral 6 denotes a black stripe portion, which is placed in a remarkably high resistant state. These constituting members are all formed on the glass substrate 5.

In the anode substrate 1, character a denotes the width of the conduction path 8*a* (conductor width), b denotes an interval between adjacent conduction paths 8*a*, 1 denotes the length of the conduction path 8*a* (conductor length), and n denotes the number of turns (returns). Thereby, it is found that the conductive film (anode electrode) 8 is coupled with the resistor and inductor as seen from the high-voltage extracting section 7.

The reactance amount (value) of the conductive film (anode electrode) 8 of the present invention is appropriately set by the number of turns n, conductor length 1 and conductor width a. For the conductive film (anode electrode) 8 of the present invention, the inductance amount (value) is preferably 1 $\mu$H or more, more preferably in a range of 1 $\mu$H (not less than 1 $\mu$H) to 1 mH (less than 1 mH).

The amount of electric charge Q is determined by the capacitance C determined by a cathode section-anode section distance and the high-voltage V to be applied in a relational equation Q=CV. The present inventor has found that if there is no reactance in the anode section (in the completely flat plate), and when the vacuum arc discharge partially occurs, the total electric charge Q flows along the discharge path at a high speed. This speed depends on the cathode section-anode section distance, but it has been observed that the total electric charge flows in a time of about several hundreds of nanoseconds to several microseconds.

In this case, the flow-in current amount is represented by $I=Q/\Delta t$. Therefore, for example, when the capacitance between the cathode section and the anode section is set to 200 pF, the applied voltage is set to 10 kV, and $\Delta t$ is set to 100 ns, the flowing current during the discharge reaches $I=200(pF)\times10(kV)/100(ns)=20(A)$. The present inventor has observed that when the current as much as 20(A) flows, the anode and cathode sections are remarkably largely destroyed.

On the other hand, since the conductive film (anode electrode) 8 of the present invention is provided with the inductor, at the occurrence of the vacuum arc discharge, the rate of the discharge current becomes very fast, and operation is performed with high impedance by the inductor. Therefore, the electric charge release time $\Delta t$ can be enlarged.

Moreover, as a result, a potential difference is small even between the adjacent anode electrodes between which the gap (cutout) 3 is held. Therefore, the surface discharge (flashover) easily generated in the gap (cutout) 3 can be restrained.

Figure 5A:
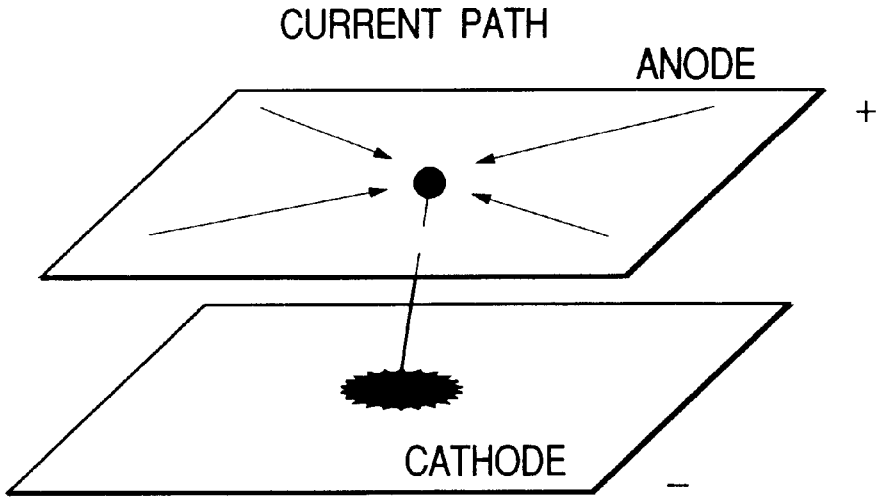
FIGS. 5A and 5B are schematic views showing the image of occurrence of a vacuum arc discharge.
Figure 5B:
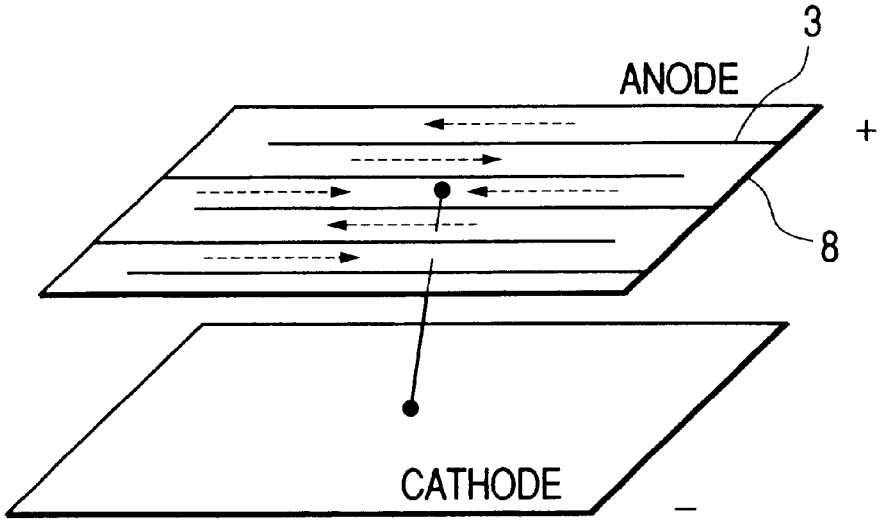

FIGS. 5A and 5B show schematic views in which the occurrence of the vacuum arc discharge is imaged. FIG. 5A is an image diagram of the vacuum arc discharge when the anode electrode is flat (without the cutout (gap)). During the vacuum arc discharge, the total electric charge Q of the anode section rapidly flows in, and a momentary short circuit state is formed. In this case, since the impedance is low, the vacuum arc discharge is finished in a considerably short time.

On the other hand, in the conductive film (anode electrode) 8 according to the present invention, even when the vacuum arc discharge occurs, as shown in FIG. 5B, the flow of electric charge is reduced by the self inductance, and the vacuum arc discharge time is lengthened. As a result, since the damage of the anode and cathode sections is mainly proportional to the current amount, the current is reduced, and the damage by the vacuum arc discharge is lowered.

In case of an image forming apparatus using a conductive film according to the present invention, when a vacuum arc discharge (abnormal discharge or short-circuit) occurs between anode and cathode, an excessively greater current (denoted by an arrow as shown in FIG. 5B) would flow rapidly through the conductive film 8.

However, as shown in FIG. 5B, at the time of the abnormal discharge, a direction of the current (denoted by the arrow in FIG. 5B) produced in the conductive film 8 is inverted (opposite) per each of adjacent conductive films 8. Accordingly, in the conductive film (anode) of the present invention, the magnetic field induced by currents in the adjacent conductive films interferes with each other. As a result, the discharge current between the anode and the cathode is restrained. The mechanism of restraining the discharge current is similar also in case of the conductive films of the structure shown in FIG. 7.

As described in the above, the conductive film for use in the image forming apparatus according to the present invention has a gap. Thus, directions of currents flowing in regions of the conductive films opposite to each other across the gap are opposite or alternating (inverted).

Further, the conductive film for use in the image forming apparatus according to the present invention has a gap. Also, directions of magnetic fields induced by current flowing in the regions in the conductive films opposite to each other across the gap are opposite or alternating (inverted).

Figure 6A:
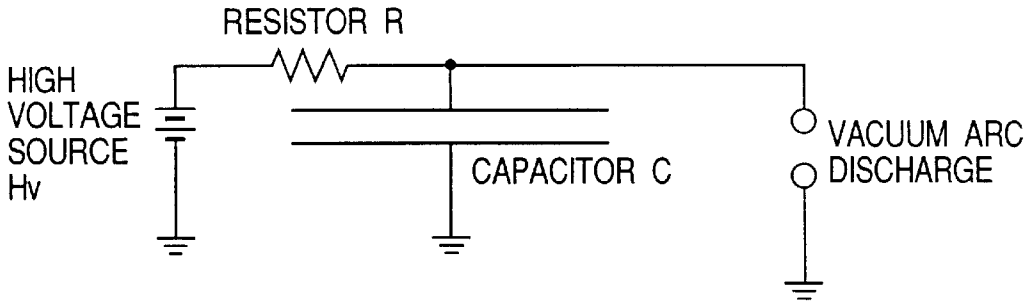
FIGS. 6A and 6B are schematic views showing the equivalent circuit of an anode section.

Details will further be described with reference to the equivalent circuit of FIGS. 6A and 6B. FIG. 6A shows the equivalent circuit when the conductive film (anode electrode) 8 according to the present invention is not used. A high voltage source is connected to a capacitor C constituted of the anode and cathode sections via a resistor R. Here, when the vacuum arc discharge occurs, a short circuit portion is partially generated between the cathode section and the anode section. In this case, the total electric charge accumulated to the capacitor C flows into the vacuum arc discharge section as the current. Since the current is not restricted, a large current flows at a high rate.

Figure 6B:
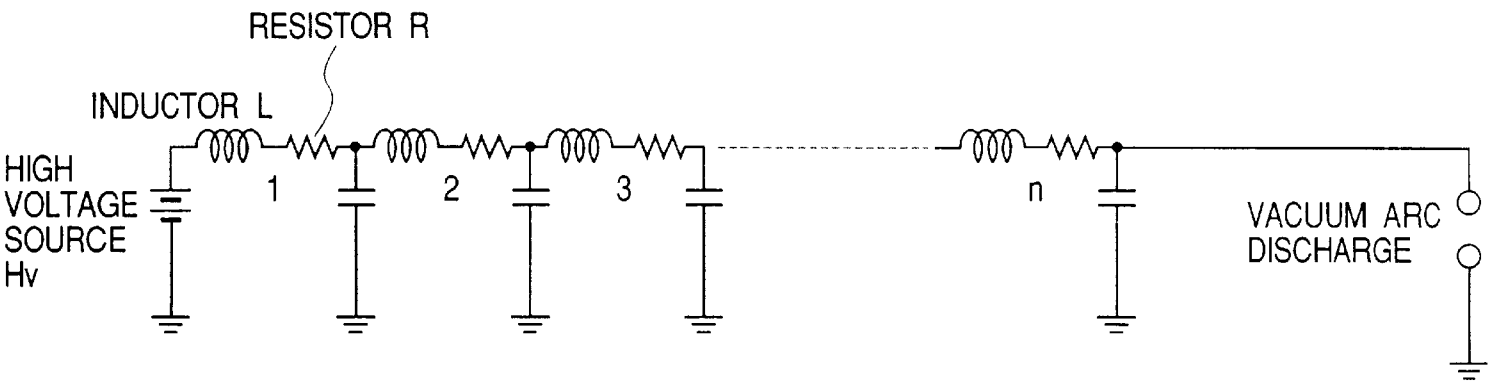

On the other hand, FIG. 6B shows the equivalent circuit when the conductive film (anode electrode) 8 of the present invention is used. As shown in FIG. 6B, since there are a large number of inductors L in the conductive film (anode electrode) 8 of the present invention, the equivalent circuit is coupled by the combinations of capacitor C, resistor and inductor L comprising divisions 1, 2, 3, . . . , n.

In this case, even when the vacuum arc discharge occurs and the short circuit is formed, the current is restricted by the resistor and inductor L, and the current value of the vacuum arc discharge section is therefore inversely proportional to the number n. Moreover, since the potential difference between the adjacent anode electrodes with the gap (cutout) 3 held therebetween (e.g., the potential difference generated between the anode substrate and the cathode substrate) is small, the surface discharge (flashover) may be restricted even at the occurrence of the vacuum arc discharge.

As described above, by using the conductive film (anode electrode) 8 of the present invention, even when the vacuum arc discharge occurs, the discharge current amount can be reduced to about 1/10 to 1/10000, so that the damage between the cathode section and the anode is minimized to an ignorable degree. Moreover, basically no resistor is positively disposed, and an equivalent resistance arrangement is entirely formed. Therefore, the potential difference generated between the anode electrodes adjacent to each other via the gap (cutout) 3 is small, and the surface charge easily generated in the gap (cutout) 3 can be restricted.

Figure 7:
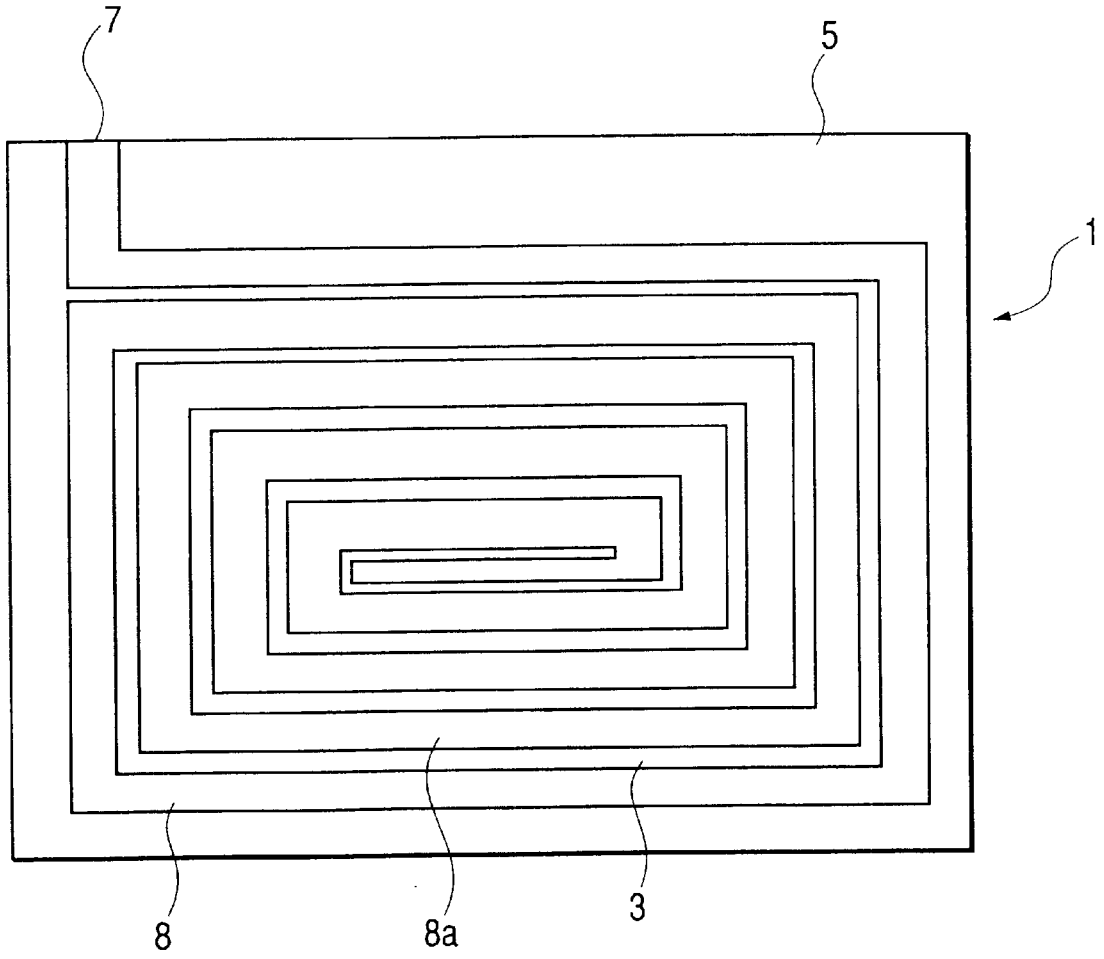
FIG. 7 is a schematic plan view showing the main constitution of the anode substrate provided with still another example of the conduction path on the metal back surface.

Moreover, the conductive film (anode electrode, metal back) 8 of the present invention may have not only the configurations shown in FIGS. 1, 3A to 3C and 4 but also the configuration shown in FIG. 7. In FIG. 7 the members denoted with the same numerals as those in FIGS. 3A to 3C indicate the same members. The anode electrode of the present invention shown in FIG. 7 has a spiral gap extended toward the central portion of the anode electrode from the outer peripheral portion of the anode electrode. In other words, the anode electrode of the present invention shown in FIG. 7 has a substantially square shape, comprises a single physically continuous conductive film, and has a spiral gap extended toward the central portion of the anode electrode from the outer peripheral portion of the square shape. Alternatively, or in other words, the anode electrode of the present invention has a substantially square shape, comprises a single physically continuous anode electrode, and has a spiral shape extended toward the central portion of the anode electrode from the outer peripheral portion of the square shape.

Figure 10B:
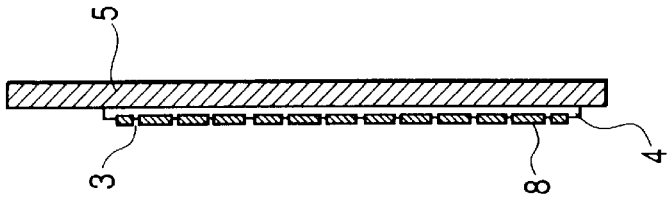
FIGS. 10A and 10B are schematic plan views showing the anode substrate according to another embodiment of the present invention.
Figure 10A:
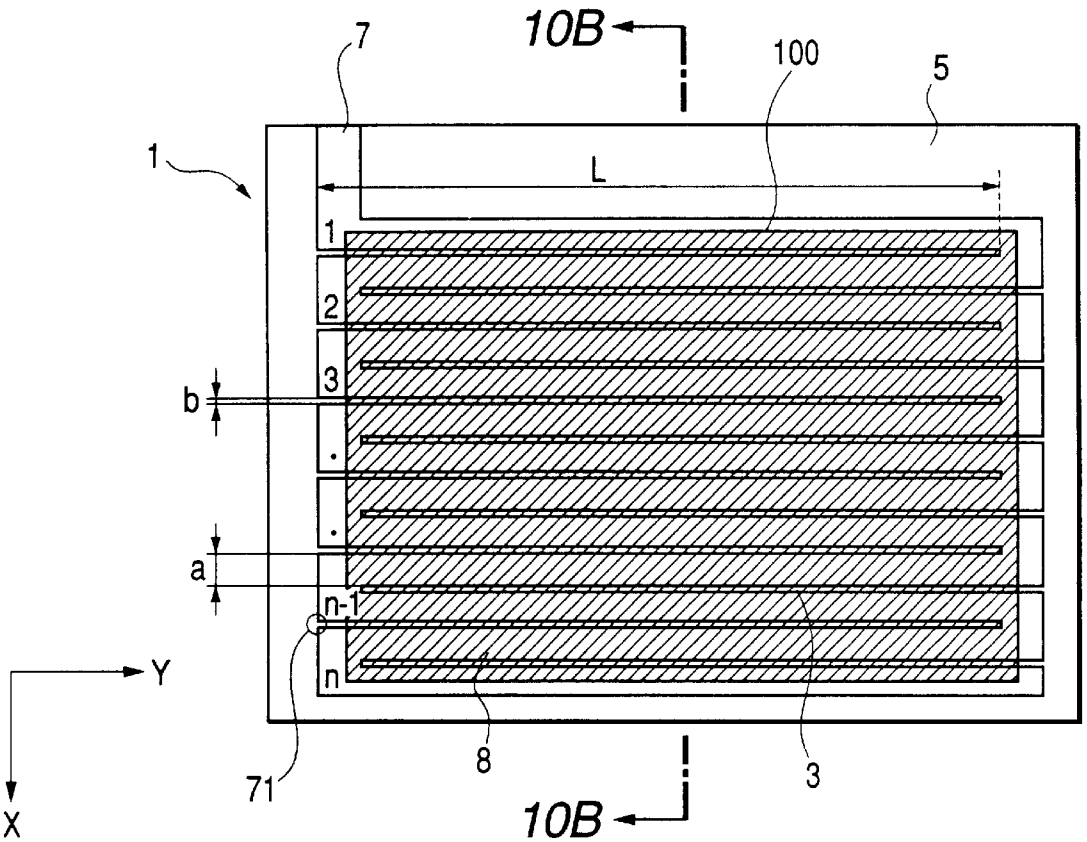

Furthermore, for the anode electrode (conductive film) 8 of the present invention, the arrangement mode of the image forming region 100 in the constitution of the anode electrode 8 shown in FIGS. 1, 3A to 3C, and 4 is schematically shown in FIGS. 10A and 10B. FIG. 10A is a plan view, and FIG. 10B is a sectional view taken along 10B—10B shown in FIG. 10A. Among the symbols used in FIGS. 10A and 10B, the same symbols as those in FIGS. 3A to 3C indicate the same members. In FIGS. 10A and 10B, numeral 100 denotes the image forming region. For the anode electrode 8 of the present invention shown in FIGS. 10A and 10B, in addition to the structure of the conductive film (anode electrode) 8 described above with reference to FIGS. 1, 3A to 3C and 4, the end 71 of the cutout (gap) 3 is not positioned in the image forming region 100 (arranged outside of the image forming region 100) shown by slant lines in FIGS. 10A and 10B. Wherein, the end 71 of the cutout (gap) 3 is a section in which a direction of a current flowing in the conductive film 8 changes by 180° (inverted). Moreover, the image forming region can be disposed inside the outer periphery of the anode electrode.

Here, "the image forming region" in the present invention basically means a substantially square region in which a plurality of electron emitting devices are arranged on the cathode substrate, that is, a region inside a line connecting the devices in endmost (outermost) positions, and a region (orthogonal projection region) formed by projecting the inside region onto an opposite face plate. Actually, however, since there is a beam extent, a region formed by considering the beam extent emitted from the device in the endmost position. In other words, the "image forming region" means a region inside a line connecting spots formed on the anode (face plate) by the electron beams emitted from the devices in the endmost (outer peripheral) positions among a plurality of electron emitting devices which contribute to the image formation, and a region (orthogonal projection region) formed by projecting the inside region onto the opposite rear plate.

In the color display, the gap 3 is preferably formed on the interval defining member 6 (black stripe or black matrix). For this purpose, the conductor width a needs to be the integral multiple of a pixel pitch, and the conductor interval (the width of the interval 3) b needs to be equal to or less than the width of the interval defining member 6 (black stripe or black matrix).

The number of windings (turns) (n) is necessarily determined by the conductor width (a), but with the decrease of the conductor width (a) the inductance or resistance per unit length increases. Since the inductance or resistance necessary for inhibiting the abnormal discharge and enhancing the dielectric strength (isolation voltage) differs with the constitution of the image forming apparatus, the size of the conductor width (a) is not particularly limited within a range in which effects can be obtained.

The potential difference produced between the adjacent anode electrodes with the gap (cutout) 3 held therebetween is always maximized at the end 71 of the gap (cutout) 3 (see FIG. 10A). Even when the surface discharge occurs, the region is limited in the vicinity of the end 71. Therefore, by forming the end 71 outside the image forming region, no damage is generated on the cathode.

In the image forming apparatus of the present embodiment, the transverse (Y-directional) size of the zigzag conductive film (anode electrode) 8 in the drawing is larger than that of the image forming region 8 shown by slant lines, and the end 71 of the cutout is present outside the image forming region, that is, in the region in which no display pixel exists.

The damage alleviating effect by the image forming apparatus of the present invention will concretely be described hereinafter based on examples.

EXAMPLE 1

In the present example, used as the image forming apparatus shown in FIG. 1 was the apparatus formed by arranging 720 surface conduction electron emitting devices 101 in the Y-direction (n=720) and 240 elements 101 in the X-direction (m=240) on the cathode substrate 2. Additionally, the capacitance formed by the anode substrate 1 and the cathode substrate 2 was about 200 pF. Moreover, the configuration of the anode electrode (conductive film) 8 in this example is schematically shown in FIGS. 3A to 3C. Furthermore, the inductance from the high-voltage extracting section Hv (7) to the terminal end of the conductive film (anode electrode) 8 was set to 2 $\mu$H.

The image was displayed by applying a high voltage of 10 kV to the anode electrode 8 of the image forming apparatus shown in FIG. 1, and driving a driver unit (not shown) connected to the X-direction wiring 103 (i.e., Dx1, Dx2, . . . , Dx(m−1), Dxm), and the Y-direction wiring 104 (i.e., Dy1, Dy2, . . . , Dy(n−1), Dyn). While various images were displayed in this state, a durability test was conducted for 1000 hours, then the vacuum arc discharge was observed twice. For the vacuum arc discharge, for example, the light emitting of the image forming apparatus can be observed with an oscilloscope by using a photo-multiplier. However, no pixel defect or the like by the vacuum arc discharge was found, no destruction was seen in the anode electrode 8 and the cathode section, and a stable and satisfactory image was held. This has revealed that the image forming apparatus of the present example is effective in alleviating the damage by the vacuum arc discharge.

EXAMPLE 2

In this example, only the pattern of the conductive film (anode electrode) 8 of the image forming apparatus of the first example was changed and used. FIG. 7 shows the configuration of the conductive film (anode electrode) 8. This example is different from the first example in that the conduction path 8*a* of the conductive film (anode electrode) 8 has a spiral shape. Additionally, the phosphor layer 4 having the R, G, B phosphors is disposed under the conductive film (anode electrode) 8, and the other constitution is basically similar to that of the first example.

This pattern was used in the conductive film (anode electrode) 8, and the image forming apparatus similar to that of the first example was prepared. The thickness of the conductive film (anode electrode) 8 was set to 300 nm, and the number of windings of the pattern was set to 60 times. Additionally, the inductance from the high-voltage extracting section 7 to the terminal end of the metal back was set to 1 $\mu$H.

Subsequently, for the prepared image forming apparatus, in a similar manner as the first example, while various images were displayed, the durability test was conducted for 1000 hours, then the vacuum arc discharge was observed three times. However, no pixel defect or the like by the vacuum arc discharge was found, no destruction was seen in the anode section and the cathode section, and the stable and satisfactory image was held. This has revealed that the image forming apparatus of the present invention is effective in alleviating the damage by the vacuum arc discharge.

EXAMPLE 3

In this example, the patterns of the conductive film (anode electrode) 8 were prepared by variously changing the thickness in order to check the thickness of the conductive film (anode electrode) 8 for placing the vacuum arc discharge damage in an allowable range. Additionally, the conductive film (anode electrode) 8 was formed in the zigzag shape shown in FIGS. 3A to 3C, and the number of turns n was fixed to 60.

Moreover, aluminum was used as the material of the conductive film (anode electrode) 8. The image forming apparatuses were prepared using the conductive films (anode electrodes) 8 various in thickness, and the color evaluation and electric discharge evaluation were carried out. Additionally, the anode voltage was set to 10 kV, and the drive mode was similar to that of the first example.

Evaluation results are shown in Table 1. Additionally, the results of Table 1 were substantially similar when the anode voltage was in a range of 5 to 15 kV.

TABLE 1

| Conductive film thickness (nm) | 20 | 30 | 40 | 50 | 100 | 200 | 300 | 400 | 500 |
|---|---|---|---|---|---|---|---|---|---|
| Color evaluation | × | Δ | ○ | ○ | ○ | ○ | Δ | × | × |
| Discharge evaluation | × | × | Δ | ○ | ○ | ○ | ○ | Δ | × |

× . . . poor
Δ . . . acceptable
○ . . . excellent

When the conductive film (anode electrode) 8 was thin, hue was bad. Moreover, in the discharge evaluation, when the conductive film (anode electrode) 8 was thin, the surface discharge (flashover) occurred between the anode electrodes adjacent to each other via the gap 3 during the arc discharge.

On the other hand, when the thickness was large, the damage by the discharge was large because of little reactance during the vacuum arc discharge. Moreover, a sufficient emission luminance was not obtained with the anode voltage of 5 to 15 kV.

According to the above-described results, the thickness of the conductive film (anode electrode) 8 is preferably in a range of 40 nm (not less than 40 nm) to 300 nm (not more than 300 nm), more preferably 50 nm to 200 nm.

EXAMPLE 4

In this example, the patterns of the conductive films (anode electrodes) 8 were prepared by changing the number of windings of the conduction path of the conductive film (anode electrode) 8, and variously changing the pattern in order to check the inductor for placing the vacuum arc discharge damage in the allowable range. Additionally, the thickness of the conductive film (anode electrode) 8 was set to 100 nm, and aluminum was used as the material of the conductive film (anode electrode) 8. The image forming apparatuses were prepared using the conductive films anode electrodes) 8 various in thickness, and the inductance measurement and discharge evaluation were performed. The inductance was measured at the high-voltage extracting section and the terminal end of the metal back. Additionally, the anode voltage was set to 10 kV, and the drive mode was similar to the first example.

Evaluation results are shown in Table 2. Additionally, the results of Table 2 were substantially similar when the thickness of the conductive film (anode electrode) 8 was in a range of 40 to 300 nm (not more than 300 nm).

TABLE 2

| Inductance ($\mu$H) | 0.5 | 1 | 2 | 5 |
|---|---|---|---|---|
| Discharge evaluation | Δ | O | O | O |

Δ acceptable
O excellent

Since the current is not sufficiently restricted during the vacuum arc discharge with a small inductance amount (e.g., 0.5 $\mu$H), an excessively slight damage occurs between the anode section and the cathode section in some cases. This has revealed that the effective inductance amount is 1 $\mu$H or more. However, if the amount exceeds 1 mH, actually, the image forming apparatus cannot appropriately be operated. Therefore, the inductance amount of the conductive film (anode electrode) 8 of the present invention is preferably equal to or more than 1 $\mu$H and less than 1 mH.

EXAMPLE 5

In this example, the image forming apparatus (FIG. 1) of the first example having the configuration of the anode electrode 8 shown in FIG. 4 was used.

Moreover, the pitch of the electron-emitting device 101 was 250 $\mu$m in the X-direction and 600 $\mu$m in the Y-direction, and the X-direction wiring 103 was formed in a width of 300 $\mu$m. Therefore, the image forming region in this example is in a range of 180 mm in the X-direction and 144 mm in the Y-direction.

Since the other constitution is similar to that of the first example, the description thereof is omitted.

Figure 11A:
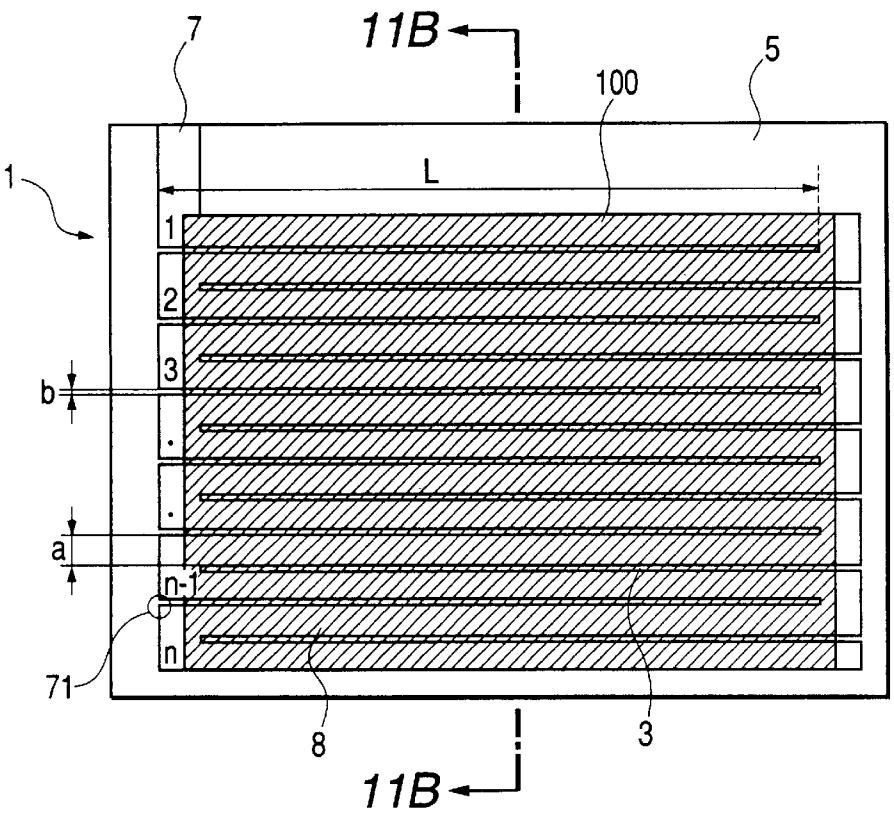
FIGS. 11A, 11B and 11C are schematic plan views showing the anode substrate according to another embodiment of the present invention.
Figure 11B:
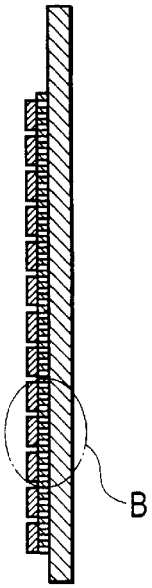
Figure 11C:
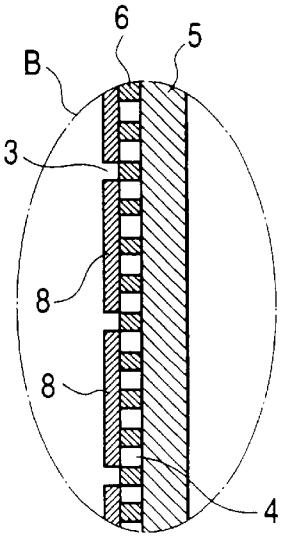

FIGS. 11A, 11B and 11C show the anode substrates used in this example, FIG. 11A is a plan view, FIG. 11B is a sectional view taken along 11B—11B shown in FIG. 11A, and FIG. 11C is an enlarged view of a part B shown in FIG. 11B.

In the image forming apparatus of this example, the size of the conductive film (anode electrode) 8 in the transverse direction of the drawing is larger than that of the image forming region 100 shown by slant lines, and a cutout end 71 is present outside the image forming region, that is, in the region in which no display pixel exists. Moreover, in order to realize the color display, the phosphors for the three primary colors are disposed, the black stripe 6 is disposed between the phosphors as shown in FIG. 11C, and the gap (cutout) 3 of the conductive film (anode electrode) 8 is formed on the black stripe 6.

Here, a method of manufacturing the anode substrate will be described. The method first comprises applying the black stripes and phosphors to the anode substrate in a precipitation process, then performing calcination, and forming the image display screen. After applying an acrylic emulsion to the phosphor, and performing the filming known as so-called smoothing of the phosphor surface, an aluminum film was deposited in a thickness of about 50 nm, and the calcination was performed in air to fly the organic filming components.

The anode electrode 8 was formed in a size of 200 mm in the X-direction and 144 mm in the Y-direction to the image forming region. Subsequently, the aluminum film was cut in a laser trimming process, and the conductive film (anode electrode) having the pattern shown in FIGS. 11A to 11C was formed. In FIG. 11A, the conductor width (a) was set to 2200 $\mu$m, the conductor interval (b) was 200 $\mu$m, the number of turns (n) was 60, and the cutout length (L) was 189 mm. Therefore, the cutout of the anode electrode is formed to 10 mm from the image forming region 100 in the X-direction on each end.

Figure 16:
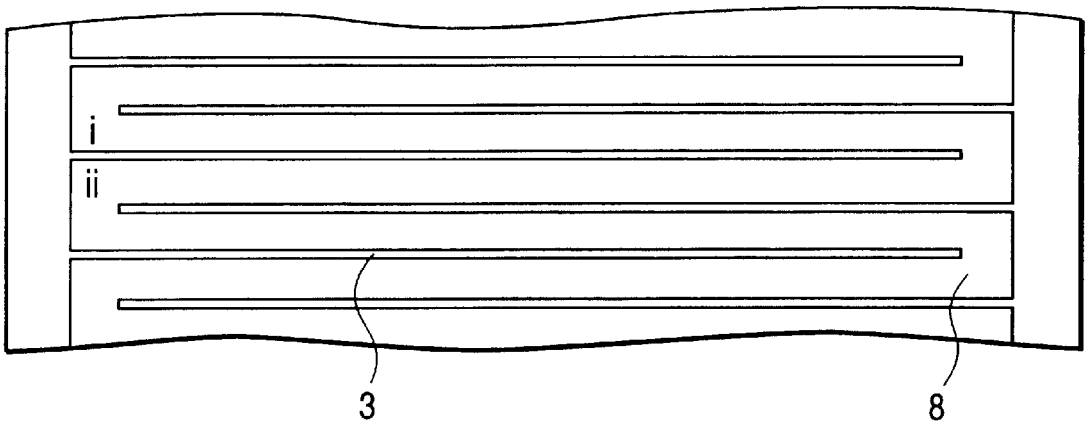
FIG. 16 is a diagram showing a portion for measuring the inductance and resistance in the anode substrate of FIGS. 11A to 11C.

When the measurement was performed between i and ii in FIG. 16 by the patterning, the inductance and resistance per winding were 200 nH, and 150 Ω, respectively.

The image forming apparatus shown in FIG. 1 was constituted using the anode substrate formed as described above, and the following durability test was performed to observe the occurrence of the abnormal discharge in the actual display.

Figure 17:
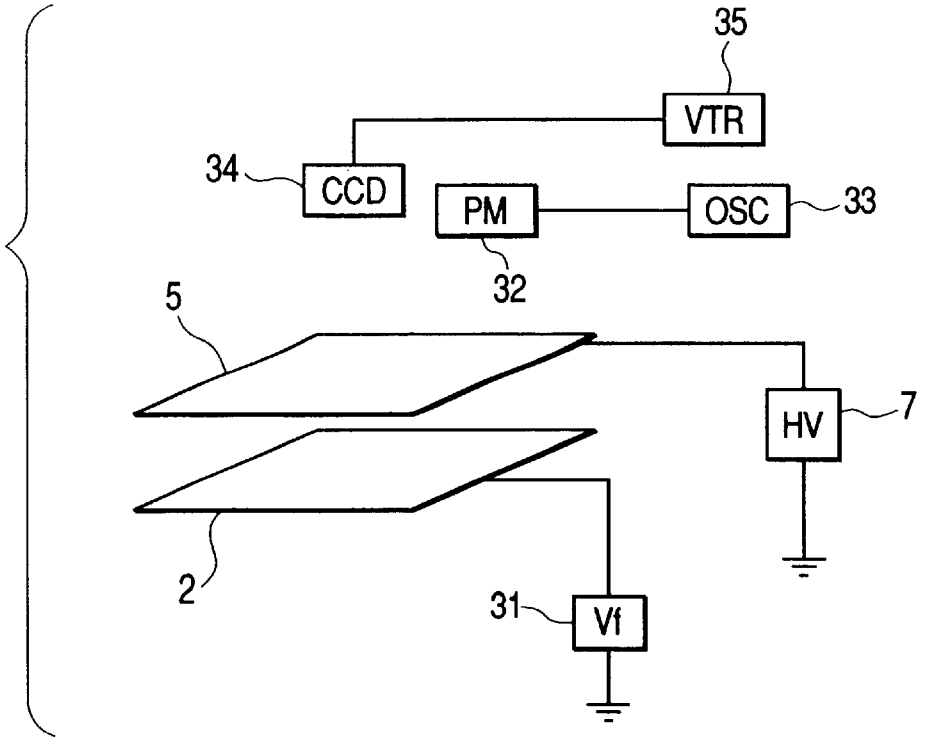
FIG. 17 is a block diagram showing the constitution of the image forming apparatus of the present invention and a measurement apparatus for observing the abnormal discharge.

The image was displayed by applying a high voltage of 10 kV to the anode electrode 8, and driving the driver unit (not shown) connected to the X-direction wiring, concretely Dox1, Dox2, . . . , Dox(m−1), Doxm shown in FIG. 1 and the Y-direction wiring, concretely Doy1, Doy2, . . . , Doy(n−1), Doyn shown in FIG. 1. While various images were displayed in this manner, the durability test was conducted for 700 hours, and the emission intensity measurement by the abnormal discharge was performed by a photo-multiplier 32 and an oscilloscope 33 in the constitution shown in FIG. 17. FIG. 17 is a block diagram showing the constitution for observing the vacuum arc discharge of the image forming apparatus in the present example. In FIG. 17, numeral 5 denotes the anode substrate, to which the high-voltage power source 7 and the anode electrode on the anode substrate 5 are connected. Moreover, numeral 2 denotes a cathode substrate, and a power source 31 for driving the electron emitting device is connected to the above-described wiring. Furthermore, numeral 32 denotes the photo-multiplier, 33 denotes the oscilloscope, 34 denotes a CCD camera, and 35 denotes a VTR.

Four abnormal discharges were detected during the durability test. In the initial two abnormal discharges, the emission in the anode cutout end 71 (FIGS. 11A to 11C) was simultaneously observed. This means that the emission was also observed in the image recorded by the video camera 35, and that the emissions were also observed at the same time during observation with a time resolution of 1/60 seconds.

The reason why the emission is observed in the cutout end 71 is supposedly that the potential difference is produced in the cutout end 71 during the occurrence of abnormal discharge and the surface discharge is caused.

Figure 12:
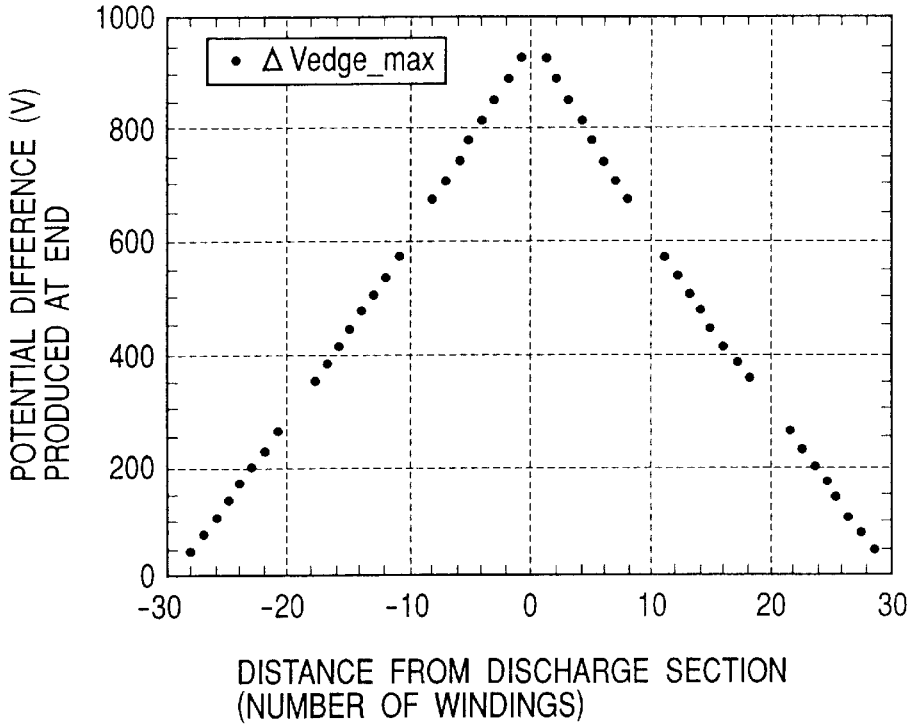
FIG. 12 is a graph showing a potential difference produced at a cutout end during occurrence of abnormal discharge.

FIG. 12 is a graph showing the measurement result of the potential difference produced in the end 71 of the gap (cutout) 3 when the applied voltage to the anode electrode 8 is 10 kV. The "distance from discharge section" on the abscissa shows the distance between the noted cutout end 71 and the discharge section by the number of windings, and the ordinate shows the potential difference in the cutout end 71 by volt. This graph reveals that a potential difference of 1 kV is produced in a gap of 200 $\mu$m in the cutout end 71 in the vicinity of the discharge section during the occurrence of discharge.

Figure 13A:
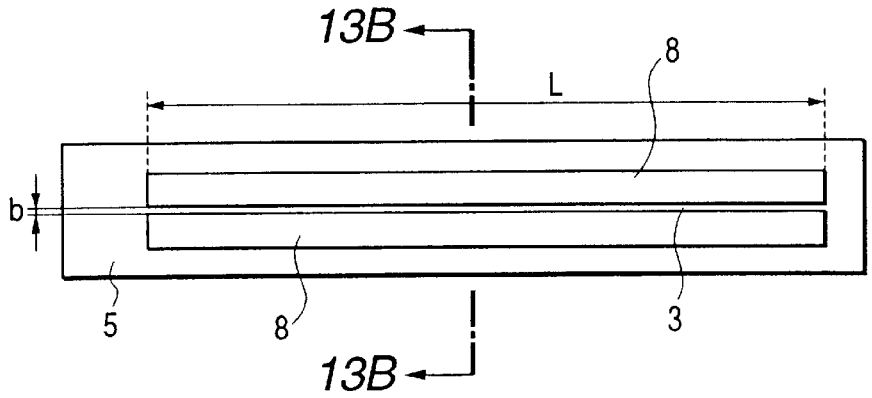
FIGS. 13A and 13B are diagrams showing a dummy substrate for use in measurement of pressure resistance between gaps at the cutout end.
Figure 13B:
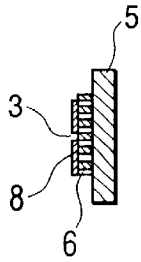

FIGS. 13A and 13B show the dummy substrate 5 prepared to measure the dielectric strength in the gap of the cutout end 71 of the anode substrate used in the present example, FIG. 13A is a plan view, and FIG. 13B is a sectional view taken along 13B—13B of FIG. 13A. In FIGS. 13A and 13B, b is set to 200 $\mu$m, and the length of the gap 3 (L) is 170 mm. The method of constituting and manufacturing the dummy substrate 5 was performed in a similar manner as the above-described anode substrate 5.

Figure 14:
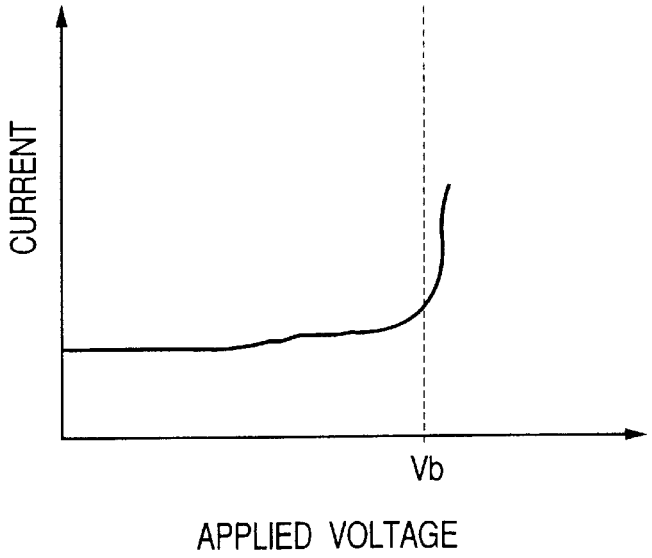
FIG. 14 is a graph showing the current/voltage characteristic of the dummy substrate of FIGS. 13A and 13B.

The dielectric strength between the conductive films 8 opposite to each other via the gap 3 was measured by measuring the current flowing between the conductive films 8 while gradually increasing the voltage to be applied between the conductive films 8. FIG. 14 is a graph showing measurement results. The current flowing between the conductive films 8 opposite to each other via the gap 3 discontinuously changes at an applied voltage Vb. This is supposedly the voltage at which the current flowing between the conductive films 8 opposite to each other via the gap 3 discontinuously changes and the surface discharge occurs between the conductive films 8 opposite to each other via the gap 3. This voltage is hereinafter called the surface discharge start voltage.

Figure 15:
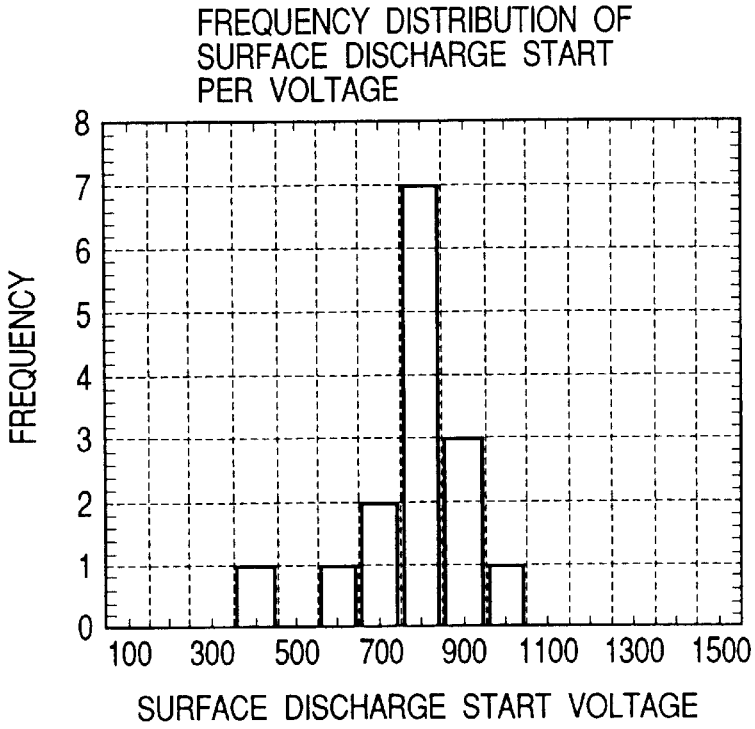
FIG. 15 is a graph showing the frequency distribution of surface discharge start per voltage.

FIG. 15 is a graph showing the frequency distribution of the surface discharge start voltage when the measurement is performed on a plurality of dummy substrates. This graph reveals that the surface discharge starts substantially at 600 to 900 V. This is supposedly because the potential difference produced at the cutout end 71 during the abnormal discharge exceeds the surface discharge start voltage and the surface discharge is induced with the abnormal discharge.

In the image forming apparatus of the present example, after the durability test was finished, it was checked whether or not any defect was produced in the element on the cathode substrate, but the damage was not particularly confirmed.

As described above, in the image forming apparatus of the present embodiment, by forming the cutout end 71 outside the image forming region, the electron-emitting devices on the cathode substrate is not damaged even when the abnormal discharge, or the surface discharge in the end 71 occurs.

According to the image forming apparatus of the present invention, various damage such as the pixel defect by the abnormal discharge can effectively be inhibited, and the image forming apparatus excessively high in reliability can be realized.

What is claimed is:

1. An image forming apparatus comprising:

a cathode substrate on which an electron emitting device is disposed; and an anode substrate in a substantially square shape, provided with an anode electrode partially having a gap, and disposed opposite to said cathode substrate, wherein said anode electrode comprises a plurality of conductive films which are connected in a series and arranged to form gaps between neighboring conductive films so that the total longitudinal length of the gaps is equal to or more than a diagonal length of the anode substrate.

2. An image forming apparatus comprising:

a cathode substrate on which an electron emitting device is disposed; and an anode substrate provided with an anode electrode partially having a gap, and disposed opposite to said cathode substrate, said anode electrode having an inductance of 1 $\mu$H or more.

3. An image forming apparatus comprising:

a cathode substrate on which an electron emitting device is disposed; and an anode substrate provided with an anode electrode, and disposed opposite to said cathode substrate, said anode electrode being an electrode formed by connecting a plurality of rectangular conductive films, said plurality of conductive films being arranged substantially parallel with one another in a longitudinal direction, and arranged with gaps in a direction orthogonal to said longitudinal direction, said conductive films adjacent to each other being interconnected at one end in the longitudinal direction so that said plurality of conductive films are electrically connected in series.

4. The image forming apparatus according to claim 3, wherein among said plurality of conductive films, for said conductive films other than a pair of conductive films positioned in an outermost section, one end of a longitudinal direction of a first conductive film is connected to an end of an adjacent conductive film, and the other end of said first conductive film is connected to an end of another adjacent conductive film.

5. An image forming apparatus comprising:

a cathode substrate on which an electrode emitting device is disposed; and an anode substrate provided with an anode electrode, and disposed opposite to said cathode substrate, said anode electrode being a continuous electrode having a square shape, said anode electrode comprising a plurality of linear gaps extended from outer peripheral portions corresponding to two opposite sides among the sides of said square shape, said linear gaps being parallel with one another and extending from one of said two sides and extending toward the other side, said linear gaps being arranged in a zigzag shape.

6. An image forming apparatus comprising:

a cathode substrate on which an electron emitting device is disposed; and an anode substrate provided with an anode electrode partially having a gap, and disposed opposite to said cathode substrate, said gap having a spiral shape extended toward a central portion of said anode electrode from an outer peripheral portion of said anode electrode.

7. The image forming apparatus according to claim 6, wherein said anode electrode comprises a single square, physically continuous electrode.

8. An image forming apparatus comprising:

a cathode substrate on which an electron emitting device is disposed; and an anode substrate provided with an anode electrode partially having a gap, and disposed opposite to said cathode substrate, said anode electrode having a shape drawn with a single stroke.

9. An image forming apparatus comprising:

a cathode substrate on which an electron emitting device is disposed; and an anode substrate provided with an anode electrode partially having a gap, and disposed opposite to said cathode substrate, said anode electrode comprising a single continuous anode electrode having a square shape, and having a spiral shape extended toward a central portion of said anode electrode from an outer peripheral portion of said square shape.

10. The image forming apparatus according to any one of claims 1 to 9, wherein a space between said anode substrate and said cathode substrate is held in a pressure reduced state, and a potential applied to said anode electrode is in a range of 5 kV to 15 kV.

11. The image forming apparatus according to claim 10, wherein said anode electrode is mainly composed of aluminum, and has a thickness equal to or more than 40 nm and less than 300 nm.

12. The image forming apparatus according to claim 11, wherein the thickness of said anode electrode is in a range of 50 nm to 200 nm.

13. The image forming apparatus according to any one of claims 1 to 9, wherein an image forming region is disposed inside an outer periphery of said anode electrode.

14. The image forming apparatus according to claim 13, wherein said image forming region has a square shape, and comprises a first region in which the electron emitting device is disposed on said cathode substrate, and a second region formed by projecting the image forming region onto an opposite face plate.

15. The image forming apparatus according to claim 13, wherein said image forming region comprises a region inside a line connecting elements in endmost positions among the electron emitting devices arranged on said cathode substrate, and a region formed by projecting the image forming region onto a face plate.

16. The image forming apparatus according to claim 13, wherein the image forming region comprises a first region inside a line connecting spots formed on said anode electrode by electron beams discharged from elements in endmost positions among a plurality of electron emitting devices which contribute to image formation, and a second region formed by projecting the image forming region onto an opposite rear plate.

17. The image forming apparatus according to any one of claims 1 to 9, wherein said anode substrate has a square shape, and the length of the gap is equal to or more than a diagonal length of said anode substrate.

18. The image forming apparatus according to any one of claims 1, 2, 3, 4, 6, 7, 8 or 9, wherein said anode electrode further comprises a plurality of linear gaps extended from the gap to be orthogonal to the gap.

19. The image forming apparatus according to any one of claims 1 to 9, wherein an insulating material is disposed in the gap.

20. An image forming apparatus comprising:

a cathode substrate on which an electron emitting device is disposed; and an anode substrate provided with an anode electrode, and disposed opposite to said cathode substrate, wherein said anode electrode is an electrically continuous unity member and has a substantially square outline, and wherein said anode electrode has a first gap extending from a first side in the square outline of said anode electrode toward a second side in the square outline opposite to the first side and a second gap extending from the second side toward the first side.

21. The image forming apparatus according to claim 20, wherein said anode electrode is connected to a single power supply only.

22. The image forming apparatus according to claim 20, wherein between said anode electrode and said anode substrate there are provided phosphors for emitting red, blue and green lights.

23. The image forming apparatus according to claim 20, wherein the first and second gaps are substantially parallel to each other.

24. The image forming apparatus according to claim 20, wherein the first gap and/or second gap are formed in plural.

25. The image forming apparatus according to any one of claims 20, 21, 22, 23 or 24, wherein said anode electrode has an inductive of 1 $\mu$H or more.

26. The image forming apparatus according to any one of claims 1, 2, 3, 5, 6, 8, 9, 20, 21, 22, 23 or 24, wherein an image forming area is formed inside an outline of said anode electrode.

* * * * *

UNITED STATES PATENT AND TRADEMARK OFFICE

CERTIFICATE OF CORRECTION

PATENT NO. : 6,426,596 B1 
DATED : July 30, 2002
INVENTOR(S) : Keisuke Yamamoto et al.

It is certified that error appears in the above-identified patent and that said Letters Patent is hereby corrected as shown below:

Column 2,
Line 22, “anther” should read -- another --.

Column 18,
Line 35, “inductive” should read -- inductance --

Signed and Sealed this

Eleventh Day of March, 2003

JAMES E. ROGAN
*Director of the United States Patent and Trademark Office*